US008998781B1

(12) United States Patent
Nelson

(10) Patent No.: US 8,998,781 B1
(45) Date of Patent: Apr. 7, 2015

(54) EXERCISE EQUIPMENT HAVING ADJUSTABLE BAND PEGS

(71) Applicant: Brunswick Corporation, Lake Forest, IL (US)

(72) Inventor: Westin Nelson, Dayton, MN (US)

(73) Assignee: Brunswick Corporation, Lake Forest, IL (US)

( * ) Notice: Subject to any disclaimer, the term of this patent is extended or adjusted under 35 U.S.C. 154(b) by 326 days.

(21) Appl. No.: 13/714,100

(22) Filed: Dec. 13, 2012

(51) Int. Cl.
*A63B 21/04* (2006.01)
*A63B 21/02* (2006.01)

(52) U.S. Cl.
CPC ..... *A63B 21/04* (2013.01)

(58) Field of Classification Search
CPC .... A64B 21/02; A64B 21/04; A64B 21/0407; A64B 21/04423
USPC ..... 482/129, 104, 133, 135, 136
See application file for complete search history.

(56) References Cited

U.S. PATENT DOCUMENTS

| | | | | |
|---|---|---|---|---|
| 3,379,434 | A * | 4/1968 | Guzaldo | 482/143 |
| 3,506,261 | A * | 4/1970 | Gregory | 482/37 |
| 4,286,782 | A * | 9/1981 | Fuhrhop | 482/99 |
| 4,360,198 | A * | 11/1982 | Waulters | 482/106 |
| 7,736,286 | B2 * | 6/2010 | Panaiotov | 482/142 |
| 7,753,830 | B1 | 7/2010 | Marsh et al. | |
| 7,927,263 | B1 | 4/2011 | Marsh et al. | |

* cited by examiner

*Primary Examiner* — Bhisma Mehta
*Assistant Examiner* — Rae Fischer
(74) *Attorney, Agent, or Firm* — Andrus Intellectual Property Law, LLP

(57) ABSTRACT

Exercise equipment is for performing exercises in an exercise zone. The exercise equipment comprises a frame and a band peg that is connected to the frame so as to be selectively movable between an active position wherein the band peg extends from the frame into the exercise zone and an inactive position wherein the band peg is retracted away from the exercise zone.

15 Claims, 8 Drawing Sheets

EXERCISE EQUIPMENT HAVING ADJUSTABLE BAND PEGS

FIELD

The present disclosure relates to exercise equipment, for example weight training equipment including weight racks and benches.

BACKGROUND

U.S. Pat. Nos. 7,753,830 and 7,927,263, the disclosures of which are hereby incorporated herein by reference in entirety, disclose exercise equipment including a weight rack frame and bench frame releasably lockable to the weight rack frame at a plurality of selectable locking locations there along.

U.S. patent application Ser. No. 13/451,304, filed Apr. 19, 2012, the disclosure of which is hereby incorporated by reference in entirety, discloses exercise equipment and adjustable band peg assemblies for exercise equipment having a base frame with a plurality of band peg holes therein. A band peg is movably connected to the base frame so as to be selectively inserted in different holes in the plurality of band peg holes while remaining connected to the base frame.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In one example, exercise equipment is for performing exercises in an exercise zone. The exercise equipment comprises a frame and a band peg that is connected to the frame so as to be selectively movable between an active position wherein the band peg extends from the frame into the exercise zone and an inactive position wherein the band peg is retracted away from the exercise zone.

In another example, the exercise equipment comprises first and second elongated band pegs that are spaced apart from each other and connected to respective frame members so as to both be selectively movable between an active position wherein the respective band pegs extend into the exercise zone and an inactive position wherein the respective band pegs are retracted away from the exercise zone; an elongated weight bar having first and second ends; and a first elastic member connecting the first end of the weight bar to the first band peg and a second elastic member connecting the second end of the weight bar to the second band peg. The first and second elastic members are configured to resist vertical movement of the weight bar from a lowered position to a raised position. The exercise equipment is configured such that movement of the weight bar parallel to the elongated first and second band pegs causes movement of said first and second band pegs from one of the active and inactive positions towards the other of the active and inactive positions such that the first and second elastic members remain in a substantially vertical orientation after said movement.

In another example, the exercise equipment is configured to resist movement of the first and second band pegs from one of the active and inactive position towards the other of the active and inactive positions when the weight bar is moved parallel to the first and second band pegs such that the first and second elastic members are angled with respect to a vertical orientation after said movement.

BRIEF DESCRIPTION OF THE DRAWINGS

Examples of exercise equipment and adjustable band pegs for exercise equipment are described with reference to the following drawing figures. The same numbers are used throughout the drawing figures to reference like features and components.

DETAILED DESCRIPTION OF THE DRAWINGS

In the present description, certain terms have been used for brevity, clearness, and understanding. No unnecessary limitations are to be inferred therefrom beyond the requirement of the prior art because such terms are used for descriptive purposes only and are intended to be broadly construed. The different apparatuses described herein may be used alone or in combination with other apparatuses. Various equivalents, alternatives, and modifications are possible within the scope of the appended claims.

Figure 1:
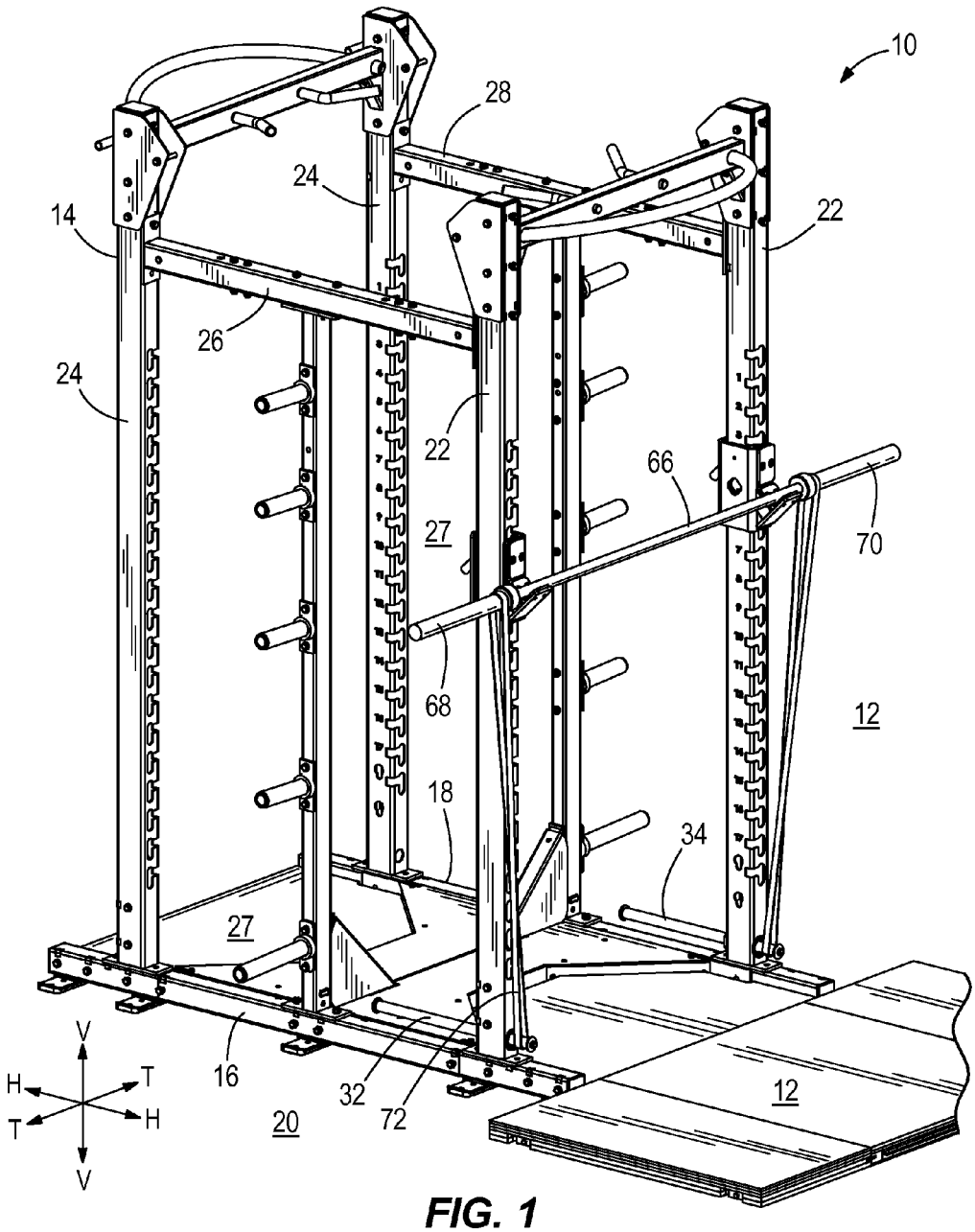
FIG. 1 is a perspective view of exercise equipment for performing exercises in an exercise zone.
Figure 2:
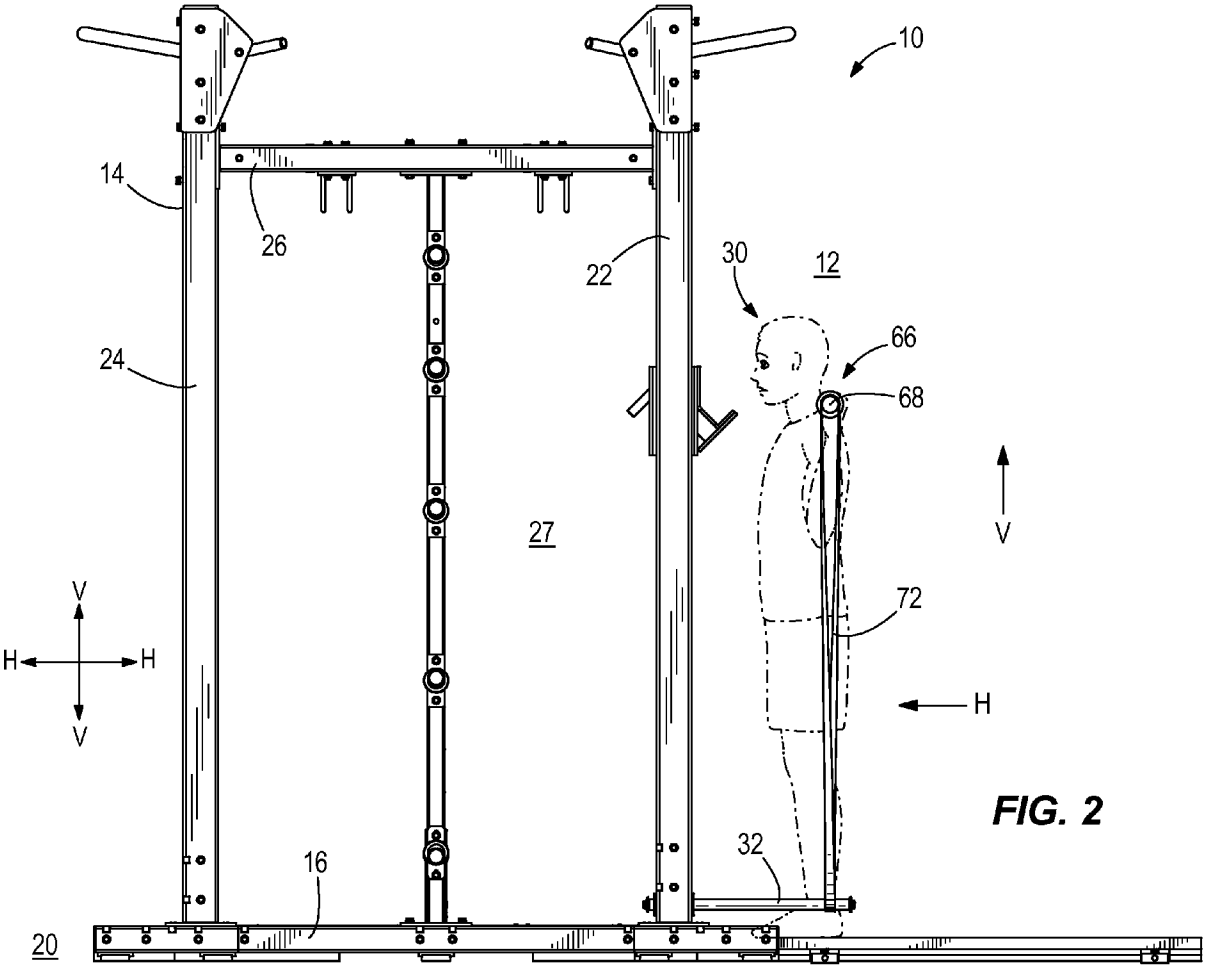
FIG. 2 is a side view of the exercise equipment having first and second elongated band pegs positioned in an active position wherein the band pegs extend into the exercise zone.
Figure 3:
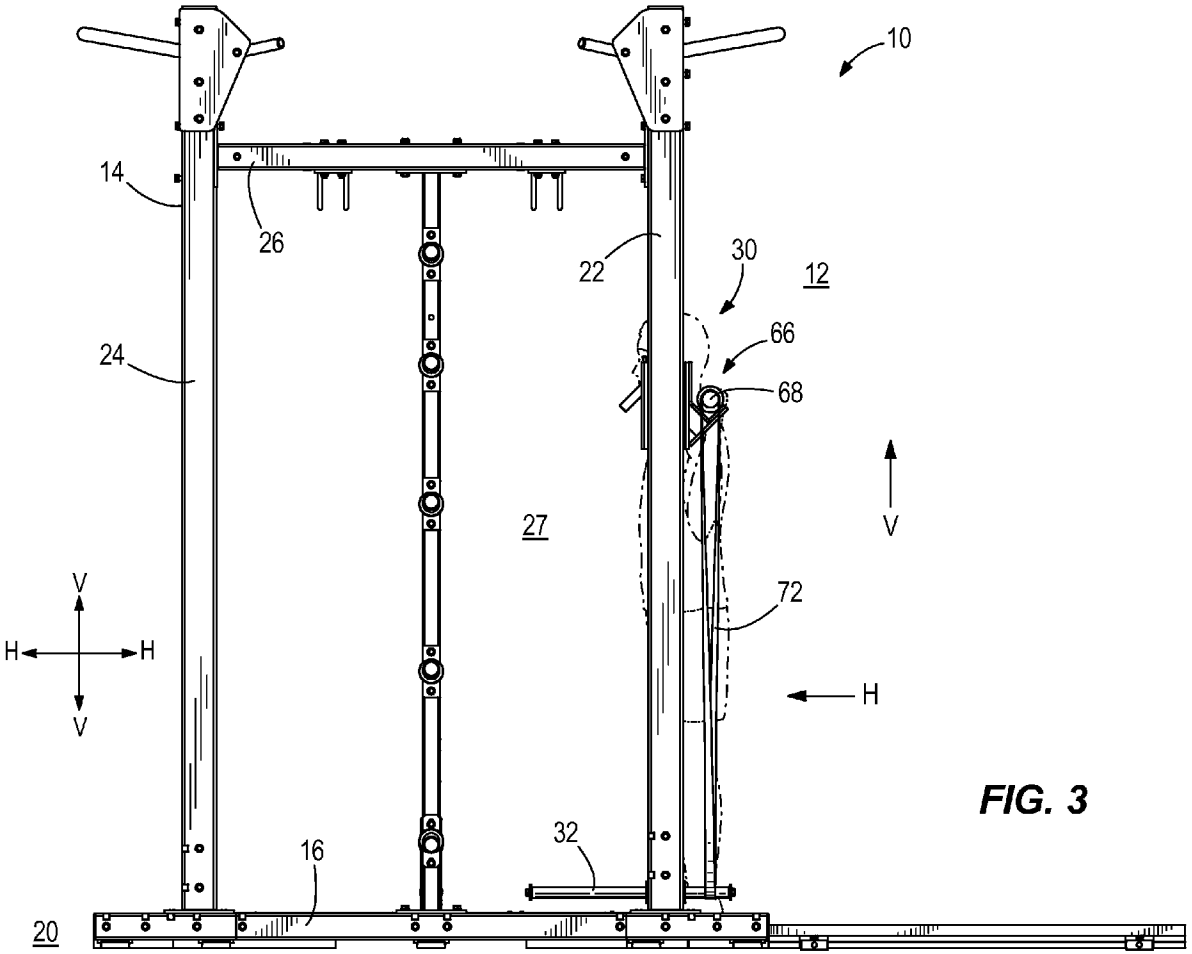
FIG. 3 is a side view showing the first and second band pegs positioned towards an inactive position wherein the respective band pegs are retracted away from the exercise zone.

FIGS. 1-5 depict a first embodiment of exercise equipment 10 for performing exercises in an exercise zone 12, which in the example shown is a three-dimensional space located outside of the exercise equipment 10, namely outside of a frame 14 having base members 16, 18 residing on the ground 20, columns 22, 24 extending upwardly from the base members 16, 18 and supports 26, 28 horizontally extending between the respective columns 22, 24. The base members 16, 18 extend in a horizontal direction H. The columns 22, 24 extend in a vertical direction V that is perpendicular to the horizontal direction H. The supports 26, 28 also extend in the horizontal direction H. The supports 26, 28 are spaced apart in a transverse direction T that is perpendicular to the horizontal direction H and perpendicular to the vertical direction. The exercise zone 12 occupies space outside of the columns 22, 24 and supports 26, 28 with respect to the horizontal direction H. Another exercise zone 27 can be disposed inside of the exercise equipment 10 with respect to the columns 22, 24 and the supports 26, 28 in the horizontal H, transverse T, and vertical V directions. FIG. 2 depicts an exemplary user 30 performing exercises in the noted exercise zone 12. FIG. 3 depicts the user 30 performing exercises out of the exercise zone 12 and in or at least close to the exercise zone 27.

However it should be understood that the exercise equipment 10 shown and described herein is exemplary only. That is, the present invention can be implemented in exercise equipment that substantially varies from that which is shown and described. For example, although the exercise equipment 10 shown and described has a frame 14 having the base members 16, 18 residing on the floor 20, columns 22, 24 extending upwardly from the base members 16, 18 and supports 26, 28 horizontally extending between the respective columns 22, 24 wherein the columns 22 are configured for supporting free weight during squat exercises, the exercise equipment 10 could also or alternatively be configured for other types of exercises such as bench presses, shoulder presses, leg presses, and or the like. That is, the exercise equipment 10 can also or alternatively be configured for any type of exercise motion that utilizes band pegs. Also the boundaries, size and/or shape of the noted exercise zones 12, 27 can vary from that which is shown. For example the exercise zone 12 can include a combination of areas inside and/or outside of the exercise equipment 10. Also the exercise zone 12 can be isolated or located adjacent one or more other exercise zones, such as the exercise zone 27.

Through research and experimentation, the present inventors have realized that fixed band pegs, such as the examples shown in the incorporated U.S. Pat. Nos. 7,753,830 and 7,927,263 can be difficult to use and in some instances present an obstruction to the user. For example, exercise chains that gathered on the floor in the exercise zone 12 can become tangled with the fixed band peg, thus presenting an obstruction, especially in instances where the chains are connected to heavy free weight devices. The present inventors sought to remedy these problems and have arrived at the following embodiments of exercise equipment and adjustable band pegs for exercise equipment.

In FIGS. 1-5, the exercise equipment 10 has first and second elongated band pegs 32, 34 that are spaced apart from each other in the transverse direction T and are connected to respective frame members (here, vertically extending columns 22, 24). In other examples, the first and second elongated band pegs 32, 34 could be connected to different frame members, such as base members 16, 18. The band pegs 32, 34 are both selectively movable between an active position (shown in FIG. 2) wherein the respective band pegs 32, 34 both extend into the noted exercise zone 12 and an inactive position (shown in FIG. 3) wherein the respective band pegs 32, 34 are retracted away from the exercise zone 12. The first and second band pegs 32, 34 are both slideably movable from the noted active position (shown in FIG. 2) to the inactive position (shown FIG. 3) and back. In this example, both of the first and second band pegs 32, 34 extend horizontally in the noted active and inactive positions and are located vertically above the respective base members 16, 18 in the inactive position and horizontally outside of the respective columns 22, 24 in the active position. Again, the position of the band pegs 32, 34 and the exercise zones 12, 27 with respect to each other and with respect to the exercise equipment 10 (e.g. frame 14) can vary from that which is shown.

Figure 4:
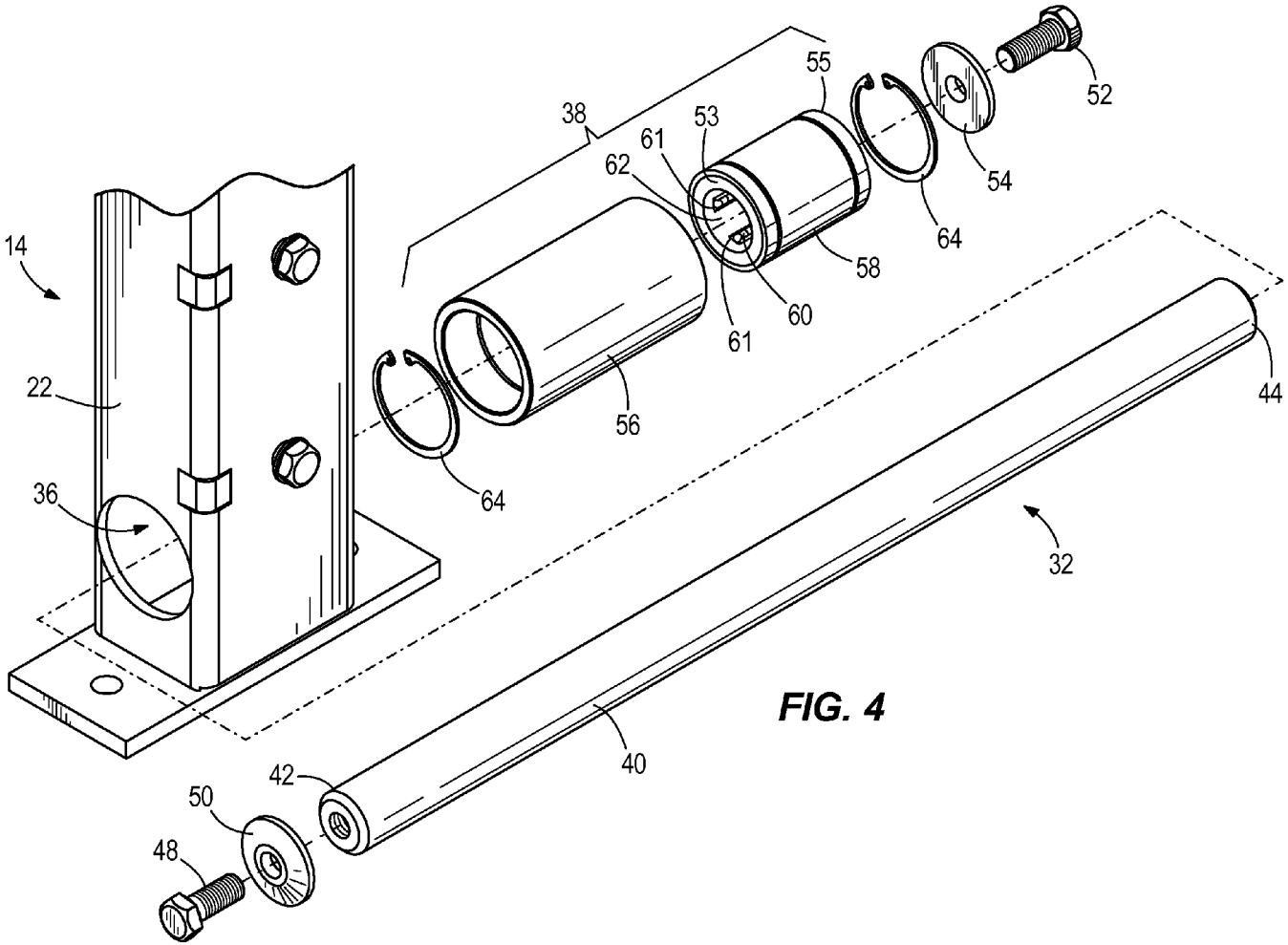
FIG. 4 is an exploded view of the first elongated band peg shown in FIGS. 1-3.
Figure 5:
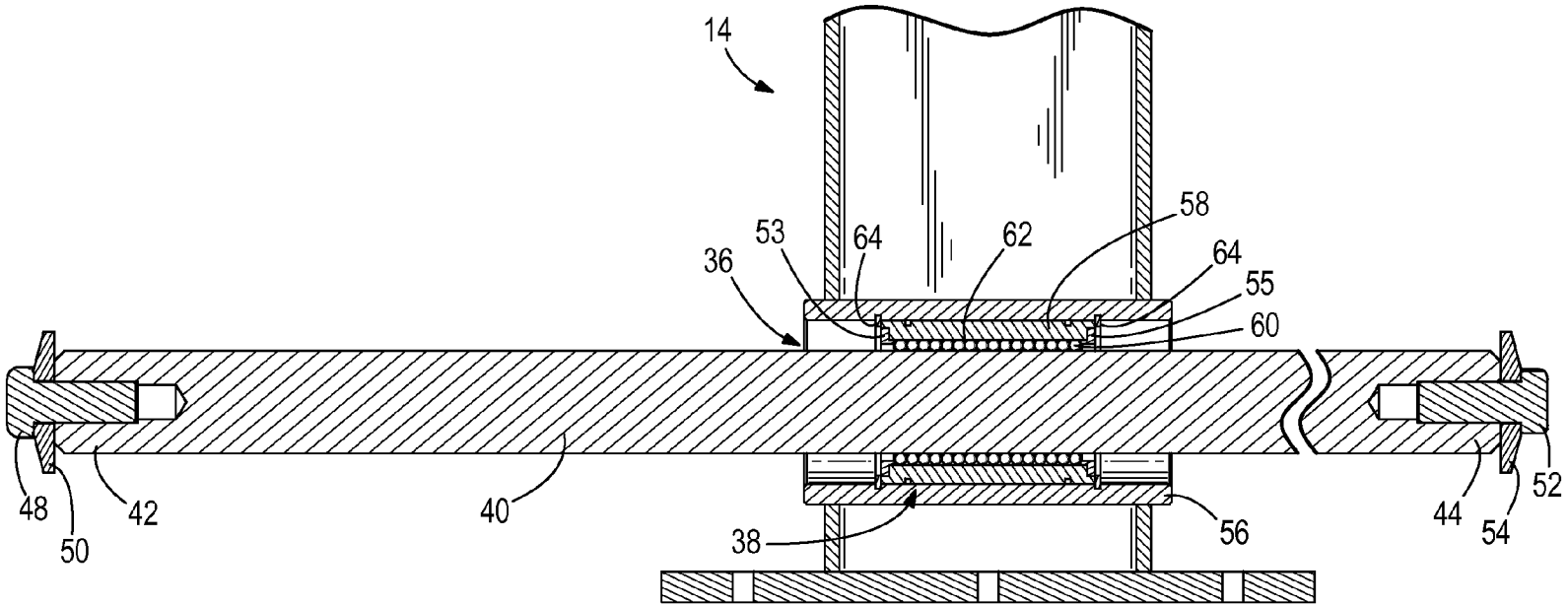
FIG. 5 is a sectional view of the band peg shown in FIG. 4.

As shown in FIGS. 4 and 5, each band peg 32, 34 extends through a through-hole 36 in the frame 14. In this embodiment, a through-hole 36 is formed in each of the columns 24, respectively, however the through-hole 36 could alternately or also be formed in the base member 16, 18. A bearing 38 supports each band peg 32, 34 with respect to the through-hole 36. The configuration and functionality of the bearing 38 can vary from that shown and described. In this embodiment, the bearing 38 is a roller bearing that supports the respective band peg 32, 34 with respect to the through-hole 36. The roller bearing 38 thus promotes free sliding movement of the band peg 32, 34 between the active and inactive positions.

Each band peg 32, 34 has an elongated shaft 40 having a first end 42 and a second end 44. A through-bore 46 is formed through the elongated shaft 40 from the first end 42 to the second end 44. A bolt 48 and washer 50 are connected to the first end 42 of the respective band peg 32, 34. A bolt 52 and washer 54 are connected to the second end 44 of the respective band peg 32, 34. The elongated shaft 40 extends through the bearing 38. In this example, the bearing 38 includes an outer sleeve 56, which has an outer diameter sized slightly smaller than the diameter of through-hole 36 so that the outer sleeve 56 fits snugly within the through-hole 36. The bearing 38 also includes an inner sleeve 58 having an outer diameter sized slightly smaller than the inner diameter of the outer sleeve 56 so that the inner sleeve 58 snugly concentrically fits within the outer sleeve 56. A plurality of ball bearings 60 are rotatably retained in grooves 61 on the inner surface 62 of the inner sleeve 58 such that the outer surfaces of the balls in the plurality 60 are in engagement with the elongated shaft 40. Engagement between the elongated shaft 40 and the plurality of ball bearings 60 promotes a rolling engagement between the shaft 40 and inner surface 62 of the inner sleeve 58, such that free movement of the first and second band pegs 32, 34 between the noted active and inactive positions is promoted. Spring clips 64 are disposed on opposite sides of the bearing 38 thereby retaining the bearing 38 with respect to the through-hole 36 in the frame 14. The washers 50, 54 stop movement of shaft 40 in the horizontal direction H. Specifically, the washers 50, 54 have an outer diameter sized larger than the inner diameter of the inner sleeve 58 such that the washers 50, 54 engage the spring clips 64 (or the opposite ends 53, 55 of the inner sleeve 58 if the spring clips 64 are omitted) to thereby stop movement of the shaft 40.

As shown in FIGS. 1-3, the exercise equipment 10 can also include a weight bar 66 having first and second ends 68, 70. A first elastic member 72 connects the first end 68 of the weight bar 66 to the first band peg 32. A second elastic member 74 connects the second end 70 of the weight bar 66 to the second band peg 34. The elastic members 72, 74 can be made of an elastic material such as rubber and can be formed as elastic bands, elastic ropes, and/or the like. The first and second elastic members 72, 74 are both configured to resist vertical movement in the direction of arrow V from a lowered position (not shown) to a raised position shown in FIGS. 2 and 3 during, for example, squat exercises.

The exercise equipment 10, including the noted bearing 38 and band pegs 32, 34 is configured such that movement of the weight bar 66 parallel to the elongated first and second band pegs 32, 34, such as shown at arrow H causes movement of the first and second band pegs 32, 34 from one of the active and inactive positions towards the other of the active and inactive positions. For example, as shown in FIGS. 2 and 3, as the user 30 steps from the exercise zone 12 (FIG. 2) towards a location that is out of the exercise zone 12 (FIG. 3), the band pegs 32, 34 freely travel from the active position shown in FIG. 2 towards the inactive position shown in FIG. 3 due to the bearing 38. The elasticity of the elastic members 72, 74, which are connected to the weight bar 66 carried by the user 30 pulls the respective band pegs 32, 34 horizontally out of the active position as the shaft 40 slides in roller bearing 38. Advantageously, this maintains the elastic members 72, 74 in a substantially vertical orientation with respect to the user, which can be preferable during certain exercises. The bearing 38 permits rotational movement of the shaft 40 as well, which can be advantageous in certain exercises.

Figure 6:
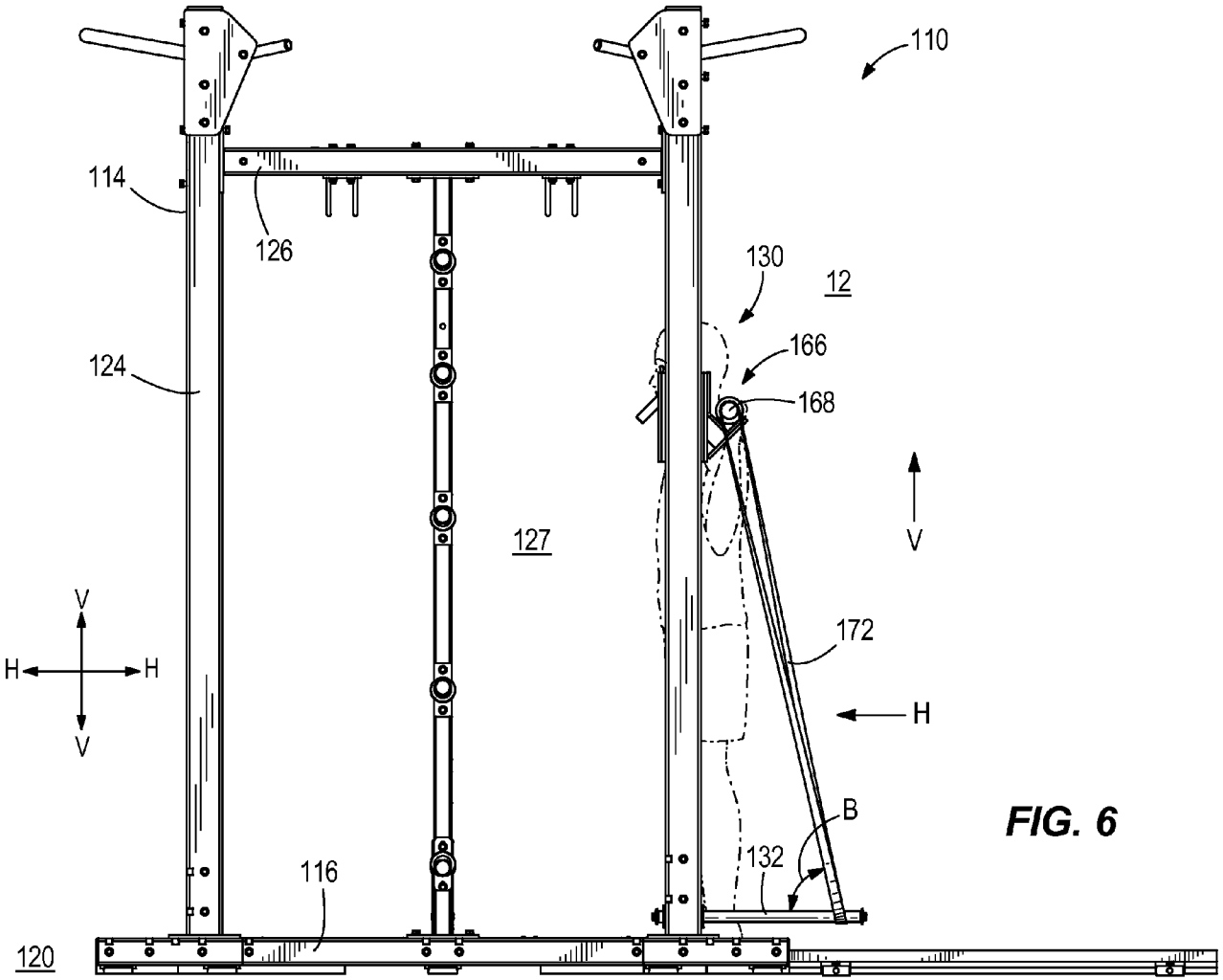
FIG. 6 is another embodiment wherein the first and second band pegs are in the active position.
Figure 7:
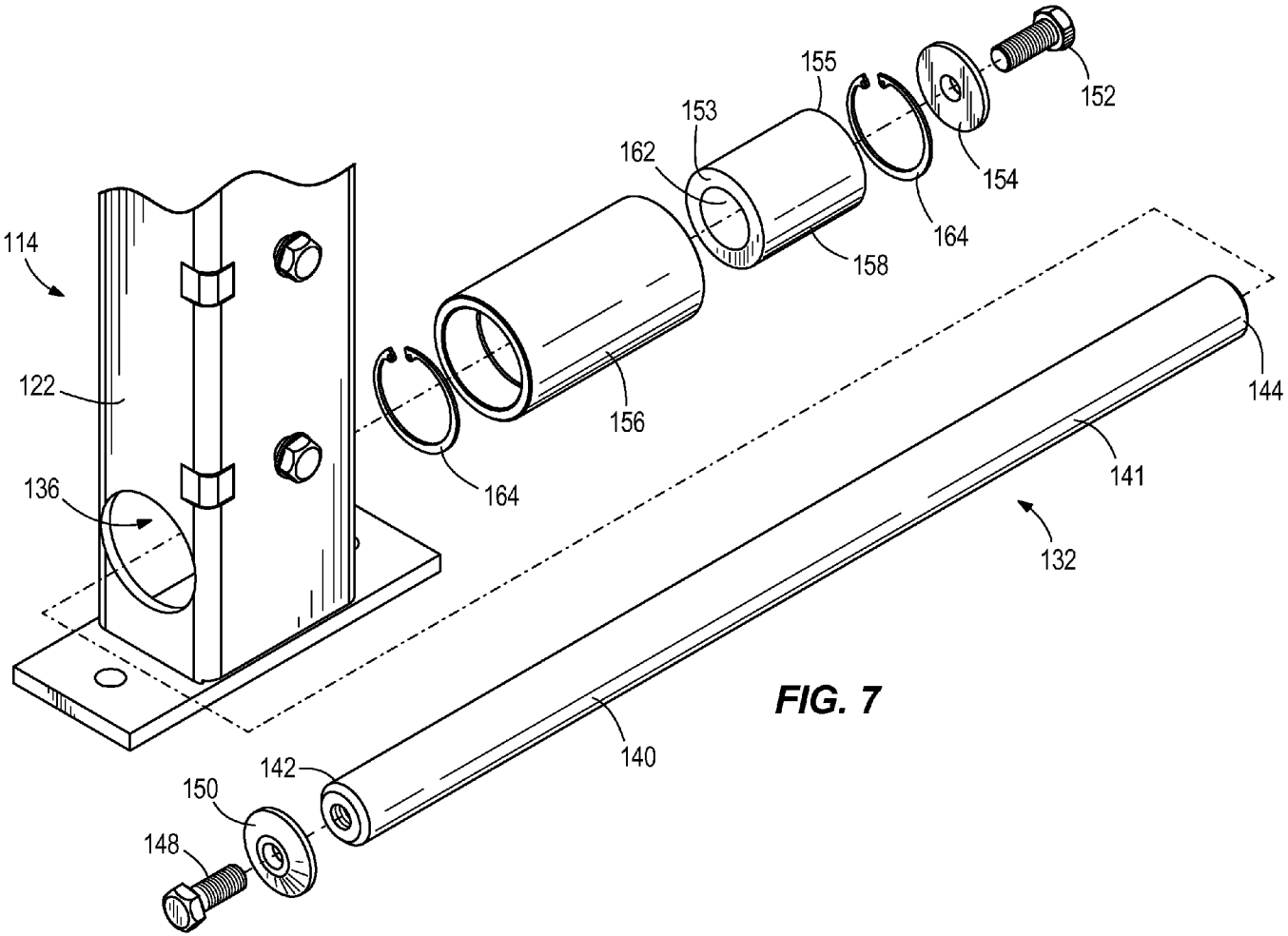
FIG. 7 is an exploded view of the first elongated band peg shown in FIG. 6.
Figure 8:
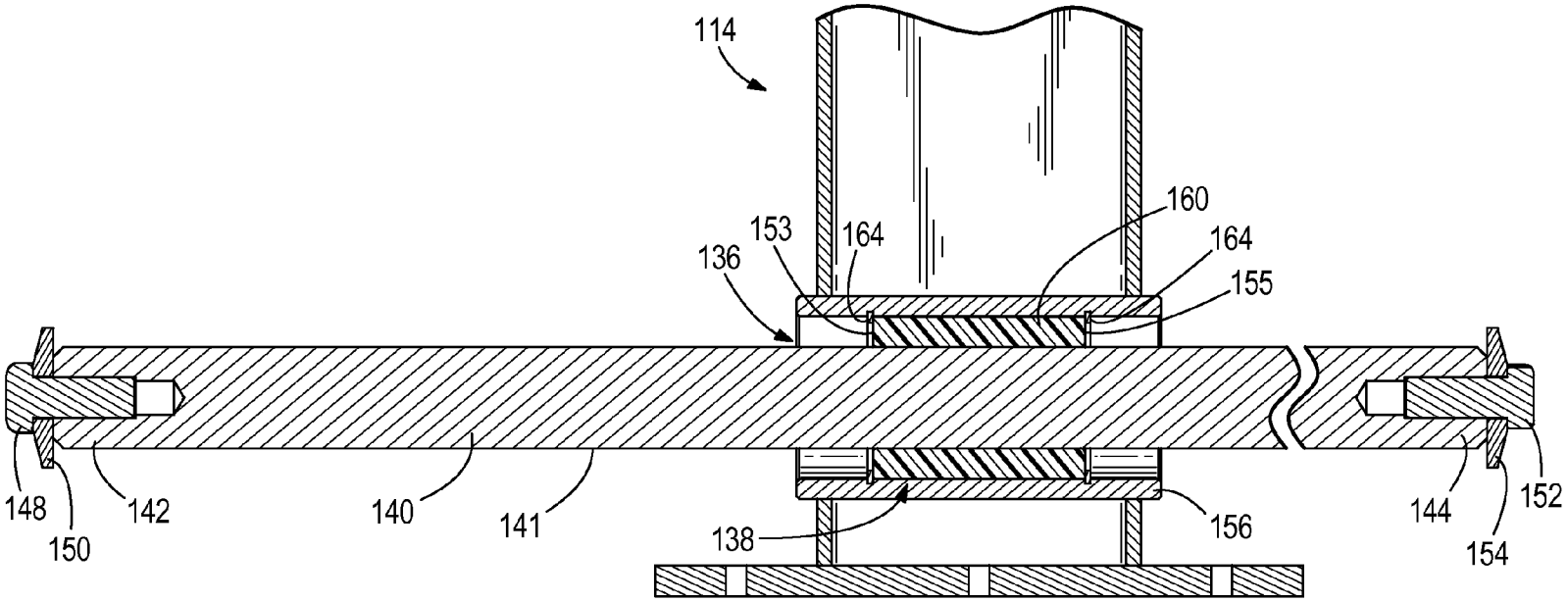
FIG. 8 is a sectional view of the band peg shown in FIGS. 6 and 7.

FIGS. 6-8 depict a second embodiment of the exercise equipment 100 having a non-roller-type bearing 138. Other structures in the second embodiment that are the same as or similar to the embodiment of FIGS. 1-5 are indicated with similar reference numbers in a corresponding "100 series". The non-roller-type bearing 138 does not have the ball bearings 160 of the first embodiment and that the smooth inner surface 162 frictionally engages with the outer surface 141 of the elongated shaft 140. As such, the bearing 138 of the exercise equipment 110 frictionally resists movement of the first and second band pegs 132, 134 between the active and inactive positions when the weight bar 166 is moved parallel to the first and second band pegs 132, 134. More specifically, surface friction between inner surface 162 and the elongated shaft 140 operates against the pulling force of the elastic members 172, 174 in the direction of arrow H. This is depicted in FIG. 6, wherein the user has stepped out of the exercise zone 112 (similar to the position shown in FIG. 3) and yet the first and second band pegs 132, 134 remain in the active position wherein the band pegs 132, 134 extend from the frame 114 into the exercise zone 112. Advantageously, changes the angle β of the elastic members 172, 174 with respect to the vertical direction V, which angled orientation can be preferable during certain exercises.

The band pegs 132, 134 are located above the profile of the base members 16, 18 and thus compared to the prior art it is much easier for the user to loop an elastic member 172, 174 on and off the band pegs. Further, the band pegs 132, 134 can easily be moved into and out of the exercise zone 12, depending upon the particular requirements of the exercise being performed.

What is claimed is:

1. Exercise equipment for performing exercises in an exercise zone, the exercise equipment comprising: a frame having a base member for residing on a floor with a column extending vertically upwardly from the base member; a band peg connected to and extending from the frame so as to be selectively and slidably movable into the exercise zone in an active position and retracted away from the exercise zone into an inactive position, wherein the band peg extends horizontally in both the active and inactive positions through a through-hole in the column, and wherein the band peg remains proximate to the base member in both the active and inactive positions; and a bearing supporting the band peg with respect to the through-hole and frictionally engaging with the band peg so as to resist free sliding movement of the band peg between the active and inactive positions during use.

2. The exercise equipment according to claim 1, comprising at least one spring clip retaining the bearing in the through-hole.

3. Exercise equipment for performing exercises in an exercise zone, the exercise equipment comprising: a frame having a base member for residing on a floor with a column extending vertically upwardly from the base member; a band peg connected to and extending from the frame so as to be selectively and slidably movable into the exercise zone in an active position and retracted away from the exercise zone into an inactive position, wherein the band peg extends horizontally in both the active and inactive positions through a through-hole in the column, and wherein the band peg remains proximate to the base member in both the active and inactive positions; and a roller bearing supporting the band peg with respect to the through-hole and allowing free sliding movement of the band peg between the active and inactive position during use.

4. The exercise equipment according to claim 3, comprising at least one spring clip retaining the roller bearing in the through-hole.

5. Exercise equipment for performing exercises in an exercise zone, the exercise equipment comprising:

first and second elongated band pegs that are spaced apart from each other and connected to respective frame members so as to both be selectively movable between an active position wherein the respective band pegs extend into the exercise zone and an inactive position wherein the respective band pegs are retracted away from the exercise zone;

an elongated weight bar having first and second ends;

a first elastic member connecting the first end of the weight bar to the first band peg and a second elastic member connecting the second end of the weight bar to the second band peg, wherein the first and second elastic members are configured to resist vertical movement of the weight bar from a lowered position to a raised position; and wherein the exercise equipment is configured such that movement of the weight bar parallel to the elongated first and second band pegs causes movement of the first and second band pegs from one of the active and inactive positions towards the other of the active and inactive positions such that the first and second elastic members remain in a substantially vertical orientation after said movement.

6. The exercise equipment according to claim 5, wherein the first and second band pegs are both slideably movable from the active position to the inactive position and vice versa.

7. The exercise equipment according to claim 6, wherein the first and second band pegs both extend horizontally in both the active and inactive positions.

8. The exercise equipment according to claim 6, wherein the frame has base members for residing on a floor and wherein the first and second band pegs are both located above the base members.

9. The exercise equipment according to claim 6, wherein the first and second band pegs both extend through respective through-holes in the frame.

10. The exercise equipment according to claim 9, wherein the frame comprises a pair of columns extending vertically upwardly from the base members and wherein the through-holes are in the pair of columns.

11. The exercise equipment according to claim 9, comprising a pair of roller bearings supporting the first and second band pegs, respectively with respect to the through-holes and allowing free movement of the first and second band pegs between the active and inactive position.

12. The exercise equipment according to claim 11, comprising spring clips retaining the pair of roller bearings in the respective through-holes.

13. Exercise equipment for performing exercises in an exercise zone, the exercise equipment comprising:

first and second elongated band pegs that are spaced apart from each other and connected to respective frame members so as to both be selectively movable between an active position wherein the respective band pegs extend into the exercise zone and an inactive position wherein the respective band pegs are retracted away from the exercise zone;

an elongated weight bar having first and second ends;

a first elastic member connecting the first end of the weight bar to the first band peg and a second elastic member connecting the second end of the weight bar to the second band peg, wherein the first and second elastic members are configured to resist vertical movement of the weight bar from a lowered position to a raised position; and wherein the exercise equipment is configured to resist movement of the first and second band pegs from one of the active and inactive position towards the other of the active and inactive positions when the weight bar is moved parallel to the first and second band pegs such that the first and second elastic members are angled with respect to a vertical orientation after said movement.

14. The exercise equipment according to claim 13, comprising a pair of bearings supporting the first and second band pegs, respectively, and frictionally engaging with the first and second band pegs so as to resist free movement of the first and second band pegs between the active and inactive position.

15. The exercise equipment according to claim 14, comprising at least one spring clip retaining the pair of bearings in the respective through-hole.

* * * * *